US011446782B2

(12) United States Patent
Swartz

(10) Patent No.: US 11,446,782 B2
(45) Date of Patent: Sep. 20, 2022

(54) SHARPENING DEVICE

(71) Applicant: KME Sharpeners, Inc., Newton, NJ (US)

(72) Inventor: Ronald Swartz, Newton, NJ (US)

( * ) Notice: Subject to any disclaimer, the term of this patent is extended or adjusted under 35 U.S.C. 154(b) by 52 days.

(21) Appl. No.: 16/004,318

(22) Filed: Jun. 8, 2018

(65) Prior Publication Data

US 2018/0354091 A1 Dec. 13, 2018

Related U.S. Application Data

(60) Provisional application No. 62/517,764, filed on Jun. 9, 2017.

(51) Int. Cl.
*B24B 3/40* (2006.01)

(52) U.S. Cl.
CPC ..... *B24B 3/40* (2013.01)

(58) Field of Classification Search
CPC .. B24B 3/40; B24B 3/36; B24B 3/456; B24B 3/543; B24B 41/066; B24B 19/001; B24B 19/002; B24B 23/08; B24D 15/08; B24D 15/06; B24D 15/065; B24D 15/084
See application file for complete search history.

(56) References Cited

U.S. PATENT DOCUMENTS 4,216,627 A * 8/1980 Westrom ..... B24D 15/063 451/175
4,441,279 A * 4/1984 Storm ..... B24D 15/06 451/175
4,471,951 A * 9/1984 LeVine ..... B24D 15/08 269/3
5,185,958 A * 2/1993 Dale ..... B24D 15/06 451/174
5,431,068 A * 7/1995 Alsch ..... B24B 41/066 269/3
6,579,163 B1 * 6/2003 Ross ..... B24B 3/36 451/540
7,867,062 B2 * 1/2011 Swartz ..... B24B 41/06 451/175
8,292,701 B2 * 10/2012 Heng ..... B24B 3/546 451/371
8,303,381 B2 * 11/2012 Schwartz ..... B24D 15/105 451/321
8,323,077 B2 * 12/2012 Nakoff ..... B24B 41/06 451/321
2017/0173760 A1 * 6/2017 Hourmand ..... B24B 3/54

* cited by examiner

*Primary Examiner* — Joel D Crandall
*Assistant Examiner* — Robert F Neibaur
(74) *Attorney, Agent, or Firm* — Rita C. Chipperson; Chipperson Law Group, P.C.

(57) ABSTRACT

A sharpening device. In one aspect, the sharpening device includes: a sharpening assembly including a sharpening unit and a rod coupled to the sharpening assembly; a retainer assembly; a coupler for coupling the sharpening assembly to the retainer assembly; an attachment device coupled to the retainer assembly for coupling the retainer assembly to a head of a blade to be sharpened.

7 Claims, 5 Drawing Sheets

SHARPENING DEVICE

CROSS-REFERENCE TO RELATED APPLICATIONS

This application claims the benefit of the U.S. provisional patent application entitled "Magnetic Sharpening Tool", having Ser. No. 62/517,764, filed Jun. 9, 2017, which is hereby incorporated by reference in its entirety as if fully set forth herein.

BACKGROUND OF THE INVENTION

Embodiments of the present invention generally relate to systems and methods for sharpening devices. More specifically, the present invention relates to systems and methods for sharpening devices including magnetic attachments and methods.

It is recognized that there is a difficulty in sharpening or re-sharpening blades, such as for example, knife blades, axe blades, and the like using hand tools and other means generally known to those skilled in the art. In particular, retention of the correct angular position of a blade relative to an abrasive medium (for example, an abrasive stone) or facilitation of repetitive smooth passes of the blade or the abrasive medium represent challenging tasks for a user of average skills.

BRIEF SUMMARY OF THE INVENTION

Disclosed is a sharpening device. In one aspect, the sharpening device includes: a sharpening assembly including a sharpening unit and a rod coupled to the sharpening assembly; a retainer assembly; a coupler for coupling the sharpening assembly to the retainer assembly; an attachment device coupled to the retainer assembly for coupling the retainer assembly to a head of a blade to be sharpened.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
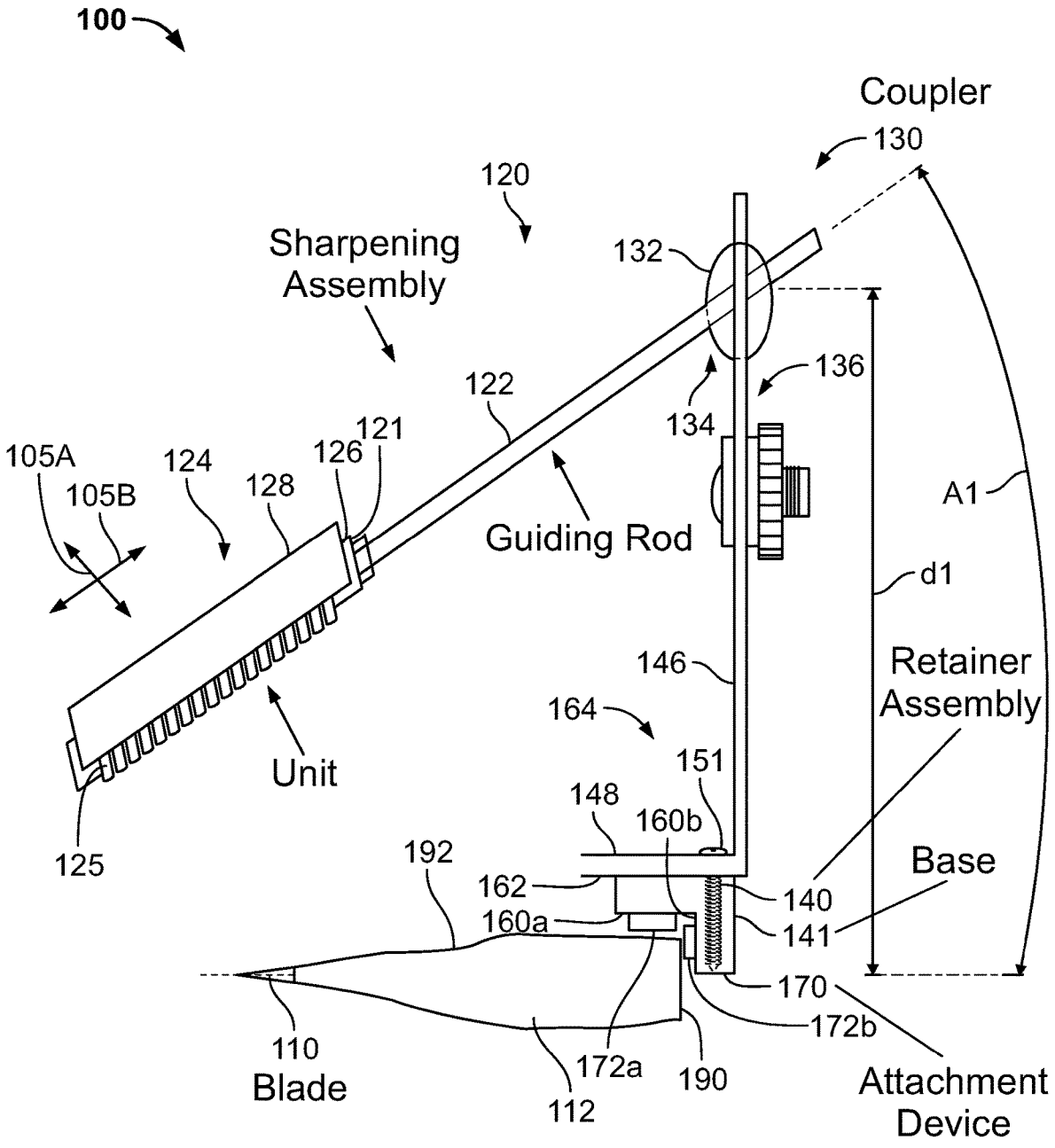
FIG. 1 depicts a side view of a sharpening device with a magnetic coupler coupled to the head of a blade in accordance with one embodiment of the present invention.

Certain terminology may be used in the following description for convenience only and is not limiting. The words "lower" and "upper" and "top" and "bottom" designate directions in the drawings to which reference is made. The terminology includes the words above specifically mentioned, derivatives thereof and words of similar import.

Furthermore, the subject application references certain processes which are presented as series of ordered steps. It should be understood that the steps described with respect to those processes are not to be understood as enumerated consecutive lists but could be performed in various orders while still embodying the invention described herein.

Where a term is provided in the singular, the inventors also contemplate aspects of the invention described by the plural of that term. As used in this specification and in the appended claims, the singular forms "a", "an" and "the" include plural references unless the context clearly dictates otherwise, e.g., "a magnet" may include a plurality of magnets. Thus, for example, a reference to "a method" includes one or more methods, and/or steps of the type described herein and/or which will become apparent to those persons skilled in the art upon reading this disclosure.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods, constructs and materials are now described. All publications mentioned herein are incorporated herein by reference in their entirety. Where there are discrepancies in terms and definitions used in references that are incorporated by reference, the terms used in this application shall have the definitions given herein.

Referring now to the FIGS. 1-8, FIG. 1 depicts a side view of a sharpening device 100 with a magnetic coupler coupled to the head of a blade in accordance with one embodiment of the present invention. The magnetic sharpening tool 100 generally comprises a sharpening assembly 120, a bearing module 130, an L-shaped retainer assembly 140 (shown in FIG. 7), and an attachment device 170. The blade 110 being sharpened may be virtually any form of blade including, without limitation, a blade of the head of an axe (as shown in FIG. 1), an arrow Broadhead, a blade of a tool, and the like.

In FIG. 1, the head of an axe is depicted lying on its side and the sharpening device is coupled to the upper end of the rearward surface and the rear end of the right facing surface of the head of the axe. The sharpening device is held in place relative to the head 112 of the blade 110 via magnets 172*a* and 172*b*. Although the depicted embodiment of the invention depicts two (2) magnets, more or less magnets may be substituted without departing from the scope hereof. For example, one magnet could be utilized (i.e., either magnet 172*a* or 172*b* could be omitted). Or more than two magnets could be substituted.

Also, in the depicted embodiment, magnets 172*a* and 172*b* are situated at an approximate right angle to each other to allow each of the magnets to adhere to a different surface of the axe head. That is, the magnets 172*a* and 172*b* are embedded or otherwise affixed to the interior sides 160*a* and 160*b*, respectively, of the L-shaped base 141 of attachment device 170 such that they are substantially perpendicular to each other. The L-shaped base 141 is inverted and coupled to the downwardly facing surface 162 of retainer assembly 140 via a fastener 151 (e.g., a screw), however, it may be fastened in any suitable manner including a nut and washer, a screw, an adhesive, welding, or the like.

Illustratively, the retainer assembly 140 includes an L shaped support 164 manufactured as a single structural element and including vertical side 146 and horizontal side 148. However, multi-part supports can be substituted without departing from the scope hereof.

Components of the sharpening device 100 may be fabricated from metals, plastics, and other suitable materials using conventional design considerations known to those skilled in the art of hand tools.

In the embodiment of the invention depicted in FIG. 1, the coupler 130 includes a spherical bearing 132 and a retainer 136 movably securing the spherical bearing 132 to the vertical side 146 of the retainer assembly 140. In the depicted embodiment (shown in detail in the exploded view of FIG. 8), the retainer 136 includes a locking bolt 160, a bracket 162, holders 133A and 133B, which together house the spherical bearing 132, a spacer 164, a thrust washer 166, and a knob 168. However, alternate methods of coupling the rod to the retainer assembly may be substituted without departing from the scope hereof. Also, alternate methods of coupling the spherical bearing 132 to the vertical wall 146 may be substituted without departing from the scope hereof.

In the embodiment of the invention depicted in FIG. 1, the spherical bearing 132 has a clear opening 134 (shown in FIG. 1 with broken lines and in FIG. 2) that is adapted for receiving, pivotally supporting, and providing a clearance fit to the rod 122. In the depicted embodiment, the spherical bearing 132 and the holders 133A, 133B are disposed in an elongated cutout 137 formed in the vertical side 146 (shown in FIGS. 7 and 8).

Figure 2:
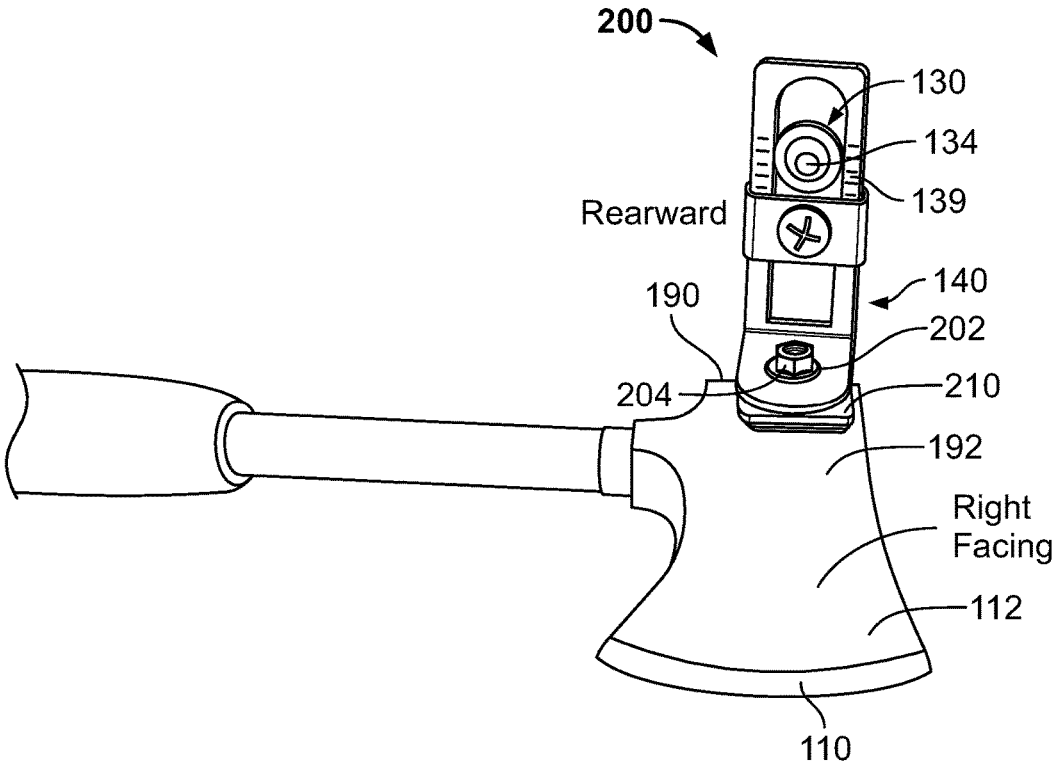
FIG. 2 shows a perspective view of the sharpening device of FIG. 1 coupled to the upper end of the rearward surface and the rear end of the right facing surface of the head of a blade.
Figure 7:
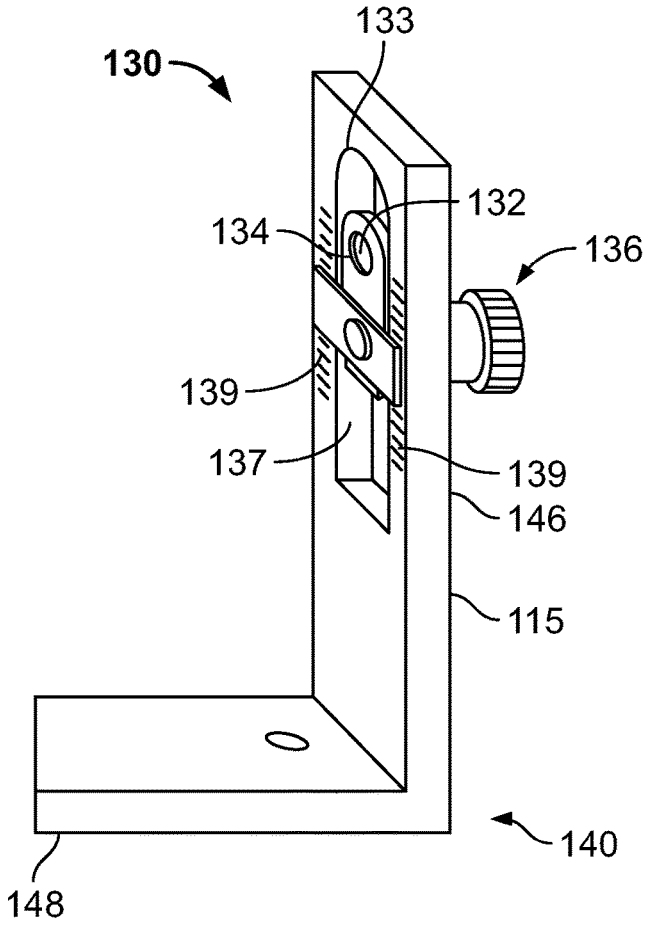
FIG. 7 depicts an angled, perspective view of a retainer assembly in accordance with one embodiment of the present invention.
Figure 8:
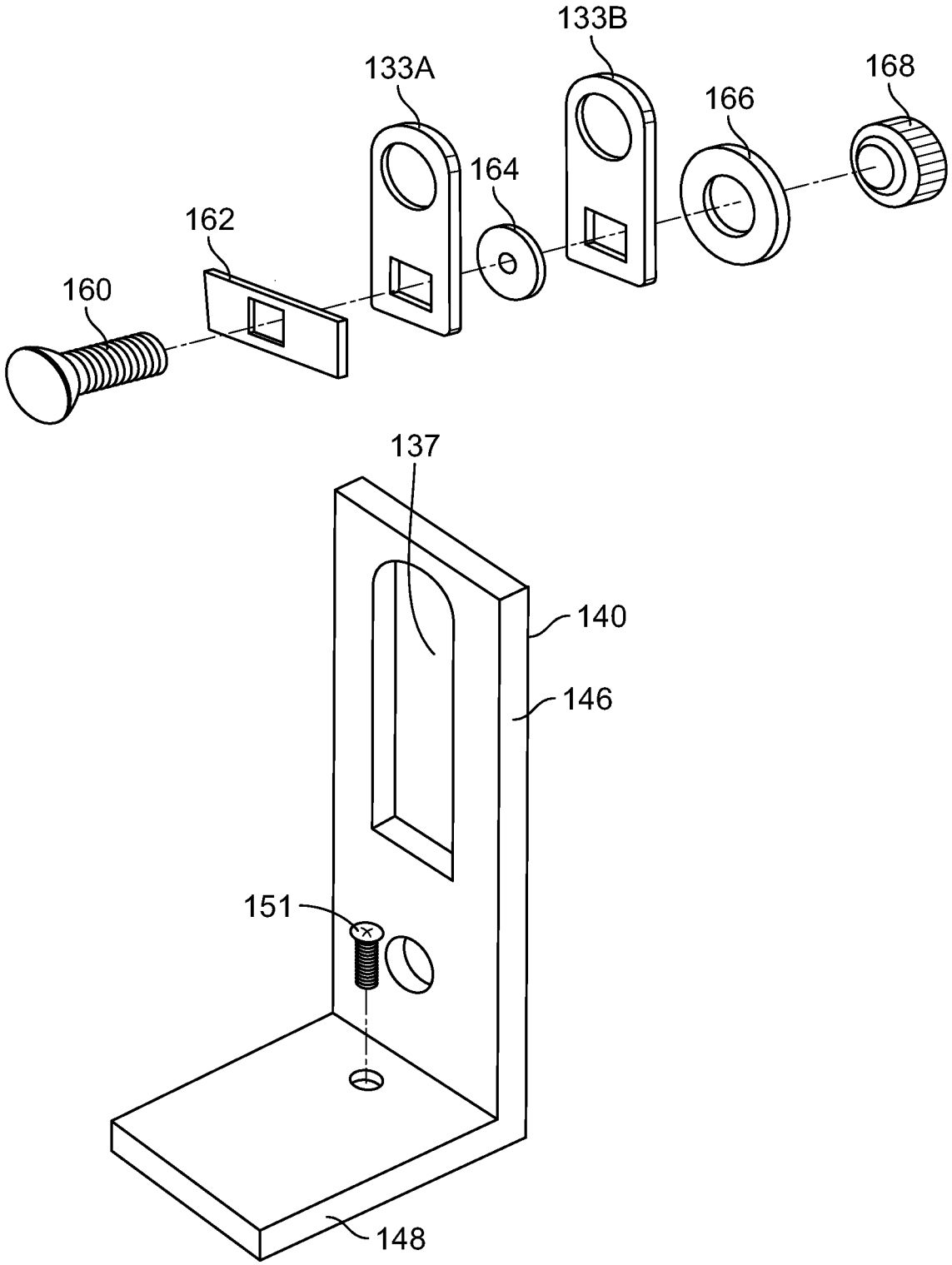
FIG. 8 depicts an exploded view of a retainer assembly in accordance with one embodiment of the present invention.

In one embodiment, the side 146 comprises a scale 139 (shown in FIGS. 2 and 7). The scale 139 (for example, engraved scale) facilitates setting the coupler 130 at a controllable (i.e., pre-selected) distance $d_1$ above the blade, thus defining an angle $A_1$ (shown in FIG. 1) at which, in operation, the abrasive sharpener 125 engages the blade 110. However, alternate methods and apparatus may be substituted for setting the location of the coupler 130 relative to the blade to be sharpened.

Figure 6:
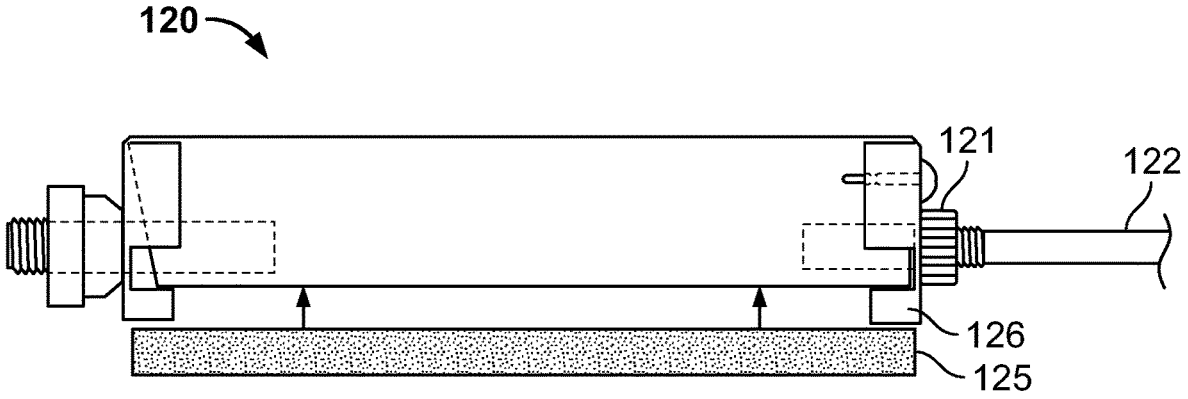
FIG. 6 depicts a side view of a sharpening assembly in accordance with one embodiment of the present invention.

As best seen in FIG. 6, the sharpening assembly 120 includes a rod 122 (e.g., a guiding rod) and a sharpening unit 124 (e.g., an abrasive stone unit 124). The sharpening unit 124 is detachably or permanently affixed to the rod 122 (using, for example, a check nut 121) and may include an abrasive sharpener 125 (e.g., sharpening or honing stone) or other object capable of sharpening a blade, an enclosure 126 releasably or permanently supporting the abrasive sharpener 125, and a handle 128. The handle 128 is adapted for applying, by hand, the abrasive sharpener 125 to the blade 110. In an alternate embodiment, the handle 128 may be a portion (for example, structural member) of the enclosure 126. In operation, the sharpening assembly 120 may be engaged in movements illustrated using arrows 105A and 105B.

More specifically, when the sharpening assembly 120 is driven by a user using the handle 128 the abrasive sharpener 125 may be engaged, tangentially with respect to the blade 110, in repetitive translational, lateral, or harmonic movements that are performed, in the directions of the arrows 105A or 105B, at the same angle 135 to the blade 110. Using the retainer 136, a user may adjust the angle $A_1$ by varying a position of the retainer 136 in the cutout 137, thereby varying the position of the sharpening assembly 120 coupled to the retainer assembly 140 (See FIG. 2)(i.e., by varying the distance $d_1$ defined by the scale 139).

In operation, a user places the blade on its side and secures the sharpening device 100 atop the head 112 of the blade 110, for example, in the position depicted in FIG. 1. Then, the user secures the abrasive unit 125 in the sharpening assembly 120, protrudes a portion of the rod 122 through the coupler 130 (e.g., the opening 134 in the spherical bearing 132), and adjusts the location of the sharpening assembly 120 relative to the blade 110 to be sharpened by adjusting the height of the retainer 136 relative to vertical side 146 of the retainer assembly 140 to select the angle $A_1$ between contacting surfaces of the abrasive sharpener 125 and the blade 110 (i.e., in this manner the user adjusts the distance $d_1$ and angle $A_1$).

In operation, the user sharpens the blade 110 by engaging the blade with the abrasive sharpener 125. In the case of double-edged blades, the user may remove the sharpening device 100 from the head of the blade, flip the blade to the side in need of sharpening, and replaces the sharpening device 100 on the top of the head thereof. In some embodiments of the invention, the user will also remove retainer assembly 136 and replace it on the opposing side of the vertical side 146 to accommodate sharpening of an alternate side of a blade.

Turning now to FIG. 2, depicted is a perspective view of an alternate sharpening device 200 with its sharpening assembly removed. In the depicted embodiment, the components of sharpening device 200 are identical to the components of the sharpening device 100 of FIG. 1 with the exception of the method of coupling the base 141 to the retainer assembly 140 and the location at which the sharpening device 200 is mounted atop the head 112 of the blade 110. In the embodiment of the invention shown in FIG. 2, retainer assembly 140 is rotatably coupled to base 141 via a threaded post 204 that extends upwardly from the upwardly facing surface 210 of base 141 through a substantially circular aperture located in the horizontal side 148 of retainer assembly 140. The coupling of retainer assembly 140 to base 141 is achieved by placing these components in the desired location and then threading fastener 212 (e.g., a nut) to the threaded post 204 until the base 141 and retainer assembly 140 are locked into place in the desired position. Also, FIG. 2 depicts the sharpening device located at the upper end of the rearward surface 190 and the rear end of the right facing surface 192 of the head 112 of a blade 110, This is just one of many locations on head 112 at which the sharpening device 100 or 200 may be located without departing from the scope hereof.

Figure 3:
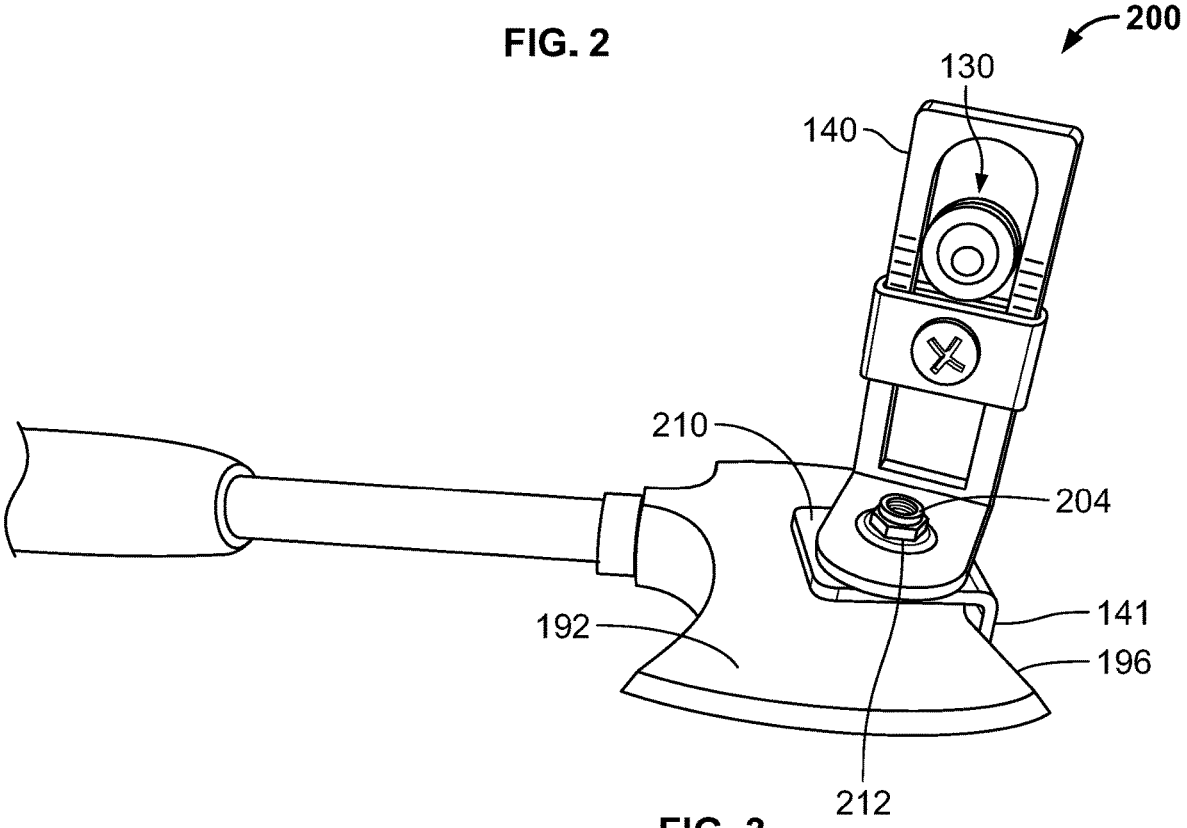
FIG. 3 shows a perspective view of the sharpening device of FIG. 1 coupled to the approximate upper midpoint of the right facing surface and the approximate midpoint of the upwardly facing surface of the head of the blade.

Referring now to FIG. 3, depicted is a perspective view of the sharpening device 200 of FIG. 2 with sharpening assembly omitted coupled to the approximate upper midpoint of the right facing surface 196 and the approximate midpoint of the upwardly facing surface 196 of the head 112 of a blade 110. Again, the position of retainer assembly 140 may be rotated relative to base 141 in order to provide the best location for the sharpening assembly and such location may vary depending upon user preference and/or the location upon the head of the blade upon which the sharpening device 200 is placed.

Figure 4:
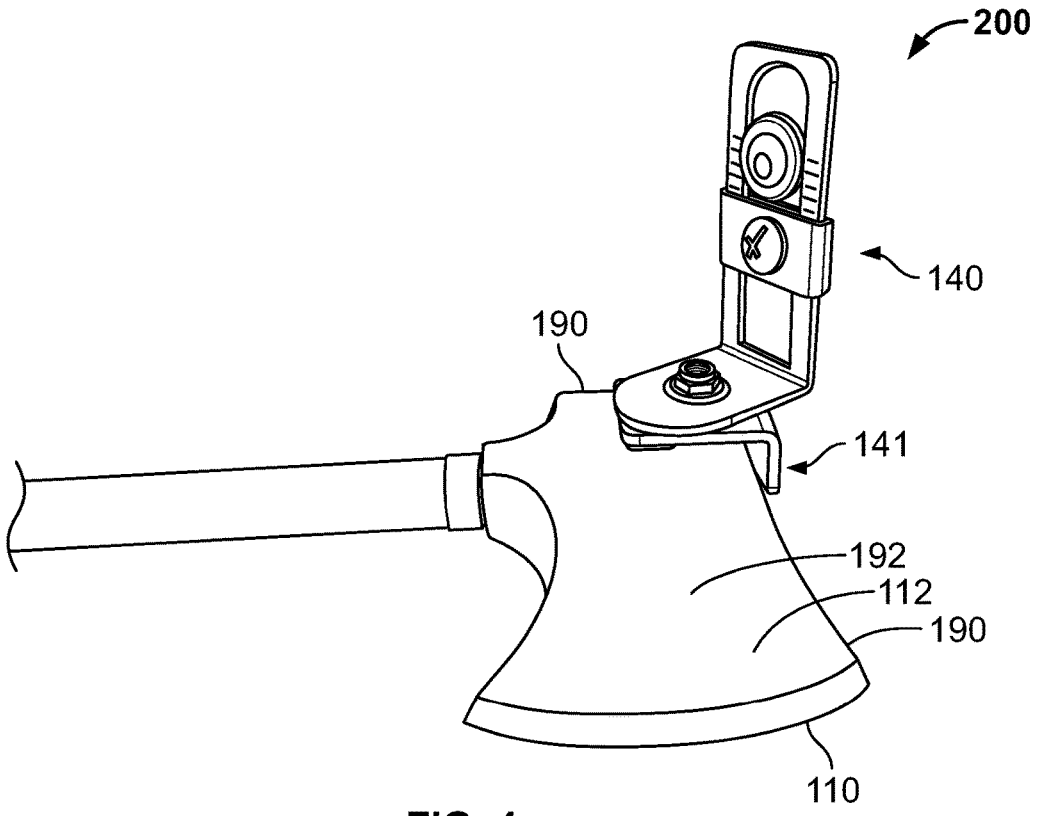
FIG. 4 shows a perspective view of the sharpening device of FIG. 1 coupled to the upper, rear end of the right facing surface and the rear end of the upwardly facing surface of the head of the blade.

Turning next to FIG. 4, depicted is a perspective view of the sharpening device 200 of FIG. 2 with sharpening assembly omitted coupled to the upper, rear end of the right facing surface 192 and the rear end of the upwardly facing surface 190 of the head of the blade.

Figure 5:
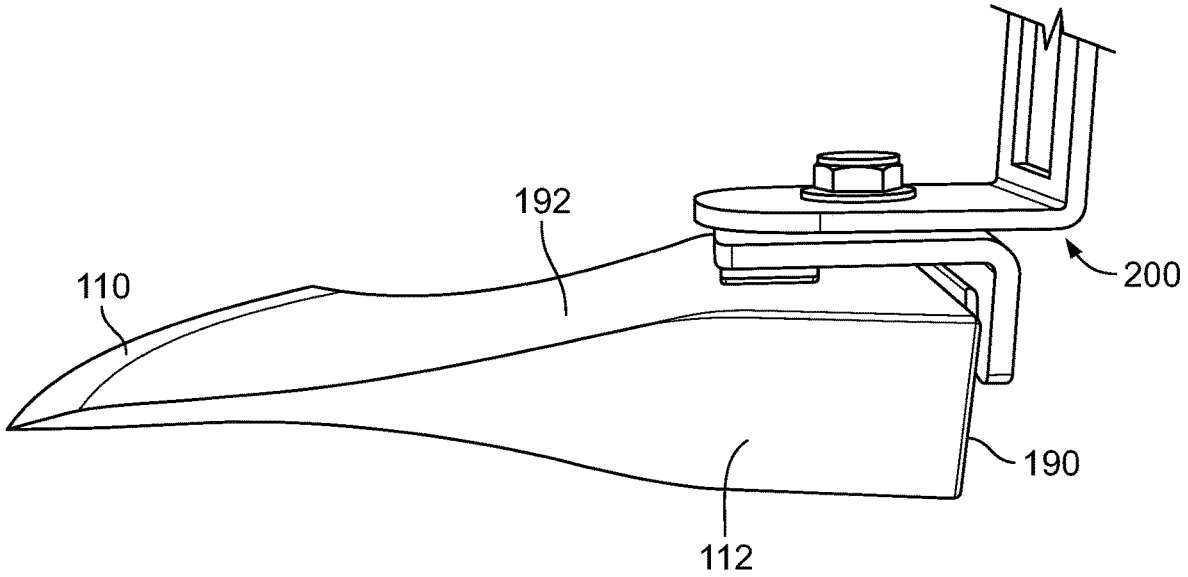
FIG. 5 shows an enlarged view of the top of the head of the blade and the coupling of the sharpening device of FIG. 1 to the upper end of the rearward surface and the rear end of the right facing surface of the head of a blade.

Referring to FIG. 5, depicted is an enlarged view of the top of the head 112 of the blade 110 and the coupling of the sharpening device 200 of FIG. 2 to the upper end of the rearward surface 190 and the rear end of the right facing surface 192 of the head 112 of a blade 110.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A sharpening device compromising:

a sharpening assembly including a sharpening unit and a rod permanently or removably coupled to the sharpening assembly;

a retainer assembly;

a coupler for coupling the sharpening assembly to the retainer assembly;

an attachment device coupled to the retainer assembly for coupling the retainer assembly to a head of a blade to be sharpened, the attachment device including at least one magnet for coupling the retainer assembly to the head of the blade to be sharpened, the at least one magnet including two magnets oriented perpendicular to each other for coupling to a front face and rear of a blade.

2. The sharpening device according to claim 1, the coupler including a bearing module.

3. The sharpening device according to claim 1, the coupler adapted to provide a clearance fit to the rod.

4. The sharpening device according to claim 1, the attachment device adapted to receive, grip, and release the head of the blade.

5. The sharpening device according to claim 1, the attachment device including an inverted L shaped attachment device base, the L-shaped attachment device base comprising at least two interior sides, each interior side of the L-shaped attachment device base including one of the two magnets.

6. The sharpening device according to claim 2, wherein the bearing module is integral to the retainer assembly and includes a spherical bearing having a clear opening providing the clearance fit to the rod.

7. The sharpening device according to claim 1, the sharpening unit including a handle adapted for engaging an abrasive stone, tangentially with respect to the blade, in repetitive translational, lateral, or harmonic movements, said handle disposed oppositely to a working surface of the abrasive stone.

* * * * *